US008894506B1

(12) United States Patent
Myers et al.

(10) Patent No.: US 8,894,506 B1
(45) Date of Patent: Nov. 25, 2014

(54) GOLF CLUB HEAD WITH ADJUSTABLE CENTER OF GRAVITY

(71) Applicant: Callaway Golf Company, Carlsbad, CA (US)

(72) Inventors: Matthew Myers, Carlsbad, CA (US); Wee Joung Kim, Vista, CA (US)

(73) Assignee: Callaway Golf Company, Carlsbad, CA (US)

( * ) Notice: Subject to any disclaimer, the term of this patent is extended or adjusted under 35 U.S.C. 154(b) by 64 days.

(21) Appl. No.: 13/778,958

(22) Filed: Feb. 27, 2013

Related U.S. Application Data

(60) Provisional application No. 61/727,608, filed on Nov. 16, 2012.

(51) Int. Cl.
*A63B 53/04* (2006.01)
*A63B 53/06* (2006.01)

(52) U.S. Cl.
CPC ..... *A63B 53/06* (2013.01)
USPC ..... 473/334; 473/335; 473/345

(58) Field of Classification Search
USPC ..... 473/335, 334, 345
See application file for complete search history.

(56) References Cited

U.S. PATENT DOCUMENTS

| | | | | |
|---|---|---|---|---|
| 6,015,354 | A * | 1/2000 | Ahn et al. | 473/256 |
| 7,147,573 | B2 | 12/2006 | DiMarco | |
| 7,166,041 | B2 * | 1/2007 | Evans | 473/334 |
| 7,611,424 | B2 | 11/2009 | Nagai et al. | |
| 7,775,905 | B2 | 8/2010 | Beach et al. | |
| 8,016,694 | B2 * | 9/2011 | Llewellyn et al. | 473/334 |
| 2006/0122004 | A1 * | 6/2006 | Chen et al. | 473/335 |
| 2006/0240908 | A1 | 10/2006 | Adams et al. | |
| 2010/0292027 | A1 | 11/2010 | Beach et al. | |

* cited by examiner

*Primary Examiner* — Michael Dennis
(74) *Attorney, Agent, or Firm* — Rebecca Hanovice; Michael A. Catania; Sonia Lari

(57) ABSTRACT

A golf club head comprising a channel and an expandable weight that can be removably fixed at any point within the channel is disclosed herein. The weight comprises at least an upper portion, a lower portion, and a bolt, and preferably is formed of a metal material co-molded with a polymeric material such as rubber. The channel has an opening with a width that is less than the width of both an inner part of the channel and the weight, such that the weight cannot fall out of the channel during use. The channel may also have an end that opens into a port, which can be filled with a plug or weight screw to prevent the weight from falling out of the channel, and also can be removed so that the weight can be removed and replaced with another expandable weight.

12 Claims, 8 Drawing Sheets

GOLF CLUB HEAD WITH ADJUSTABLE CENTER OF GRAVITY

CROSS REFERENCES TO RELATED APPLICATIONS

The present application claims priority to U.S. Provisional Patent Application No. 61/727,608, filed on Nov. 16, 2012, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a weight for a golf club head that can be adjusted along a continuous channel.

2. Description of the Related Art

The ability to adjust center of gravity location and weight in the head of driving clubs is useful for controlling performance of the golf club. The prior art includes several different solutions for adjustable weighting, but these solutions do not optimize weight adjustment. There is a need for a weighting mechanism that allows for simple and flexible center of gravity (CG) and moment of inertia (MOI) adjustability.

BRIEF SUMMARY OF THE INVENTION

The present invention is a novel way of working with adjustable products. The present invention allows consumers to easily move and fix a weight at any location within a channel in their golf club head. The objective of this invention is to provide an adjustable weight with minimal or no effect on appearance at address while maximizing the ability of the weight to adjust center of gravity height. Additional goals include minimizing the fixed component of the structure dedicated to the weighting system and also minimizing any potential effect on impact sound. Yet another object of the present invention is an adjustable weighting feature for lateral or vertical center of gravity control which is placed to maximize effectiveness and may be entirely concealed from view at address.

Another aspect of the present invention is a golf club head comprising a body comprising a channel and a port, an expandable weight, and a plug sized to fit within the port, wherein the expandable weight is disposed within and movable to any point within the channel, and wherein expanding the weight reversibly fixes it in place within the channel. In some embodiments, the expandable weight may comprise an upper portion, a lower portion, and a bolt, and in some further embodiments at least one of the upper portion and the lower portion may be composed of a material, such as stainless steel or tungsten alloy, that is co-molded with a polymeric material, such as a rubber material. In some embodiments, the upper portion may comprise a depression and a threaded bore sized to receive the bolt, and the lower portion may comprise a cavity and a projection sized to fit within the depression. In alternative embodiments, the upper portion may comprise a projection and a threaded bore sized to receive the bolt, and the lower portion may comprise a cavity and a depression sized to receive the projection.

In some embodiments, the channel may comprise an open first end and a closed second end, the port may be disposed at the first end, and inserting the plug into the weight port may close the first end of the channel. In some further embodiments, the port may be a weight port and the plug may be a weight screw. In other embodiments, the channel may comprise an innermost surface and an opening, the opening may comprise a first width, the innermost surface may comprise a second width, the expandable weight may comprise a third width, and the first width may be less than the second width and less than the third width.

In still other embodiments, the body may comprise a face, a crown, and a sole. In one further embodiment, the channel and the weight port may each be disposed in one of the crown or the sole, while in other embodiments, the body may further comprise a ribbon, and the channel and the weight port may each be disposed within the ribbon. In some embodiments, the channel is tube shaped. In other embodiments, the golf club head may be selected from the group consisting of a driver head, a fairway wood head, and a hybrid head.

Yet another aspect of the present invention is a driver-type golf club head comprising a composite crown, a titanium body comprising a face, a sole, a channel, and a weight port, a weight screw sized to fit within the weight port, and an expandable weight comprising an upper portion, a lower portion, a bolt, and a first width, wherein at least one of the upper portion and the lower portion comprises a metal material that is co-molded with a polymeric material, wherein the channel comprises an opening having a second width and an innermost surface having a third width, wherein the second width is less than both the first width and the third width, wherein the expandable weight is contained within and movable to any point within the channel, and wherein expanding the weight reversibly fixes it in place within the channel. In some further embodiments, the channel may comprise an open first end and a closed second end, the weight port may be disposed at the first end, and inserting the weight screw into the weight port may close the first end of the channel and prevent the expandable weight from leaving the channel. In other embodiments, the polymeric material may be a rubber material. In still other embodiments, at least one side of the channel may be provided by the composite crown.

Another aspect of the present invention is a golf club head comprising a body comprising a sole and a channel, an expandable weight disposed, and movable to any point, within the channel, and a cover fixture, wherein affixing the cover fixture to the sole traps the expandable weight within the channel, and wherein expanding the weight reversibly fixes it in place within the channel. In some embodiments, the expandable weight may comprise an upper portion, a lower portion, a bolt, and a first width, and at least one of the upper portion and the lower portion may be composed of stainless steel co-molded with a polymeric material.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
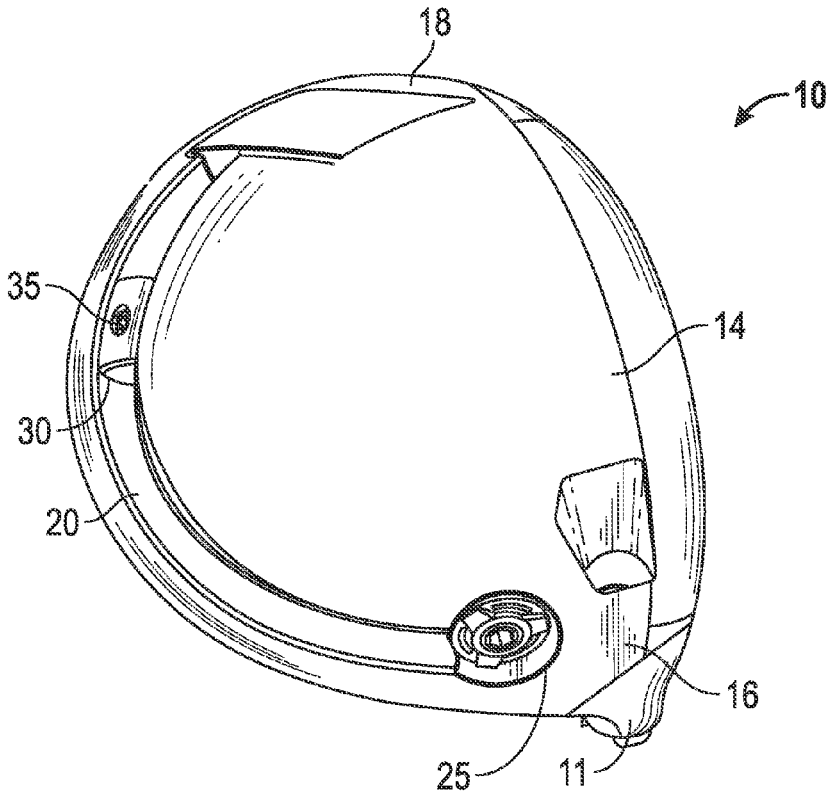
FIG. 1 is a bottom perspective view of a golf club head encompassing a first embodiment of the present invention.
Figure 2:
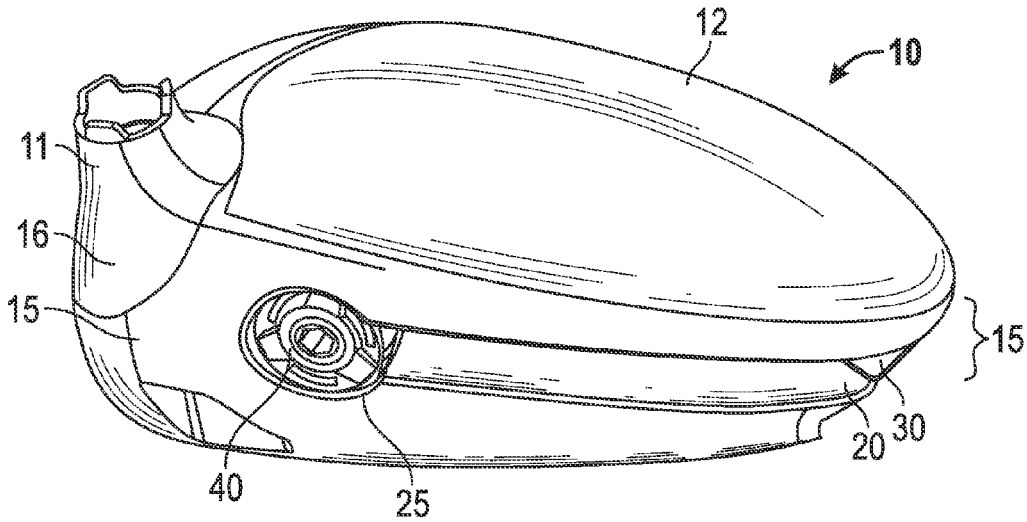
FIG. 2 is a first side perspective view of the embodiment shown in FIG. 1.
Figure 3:
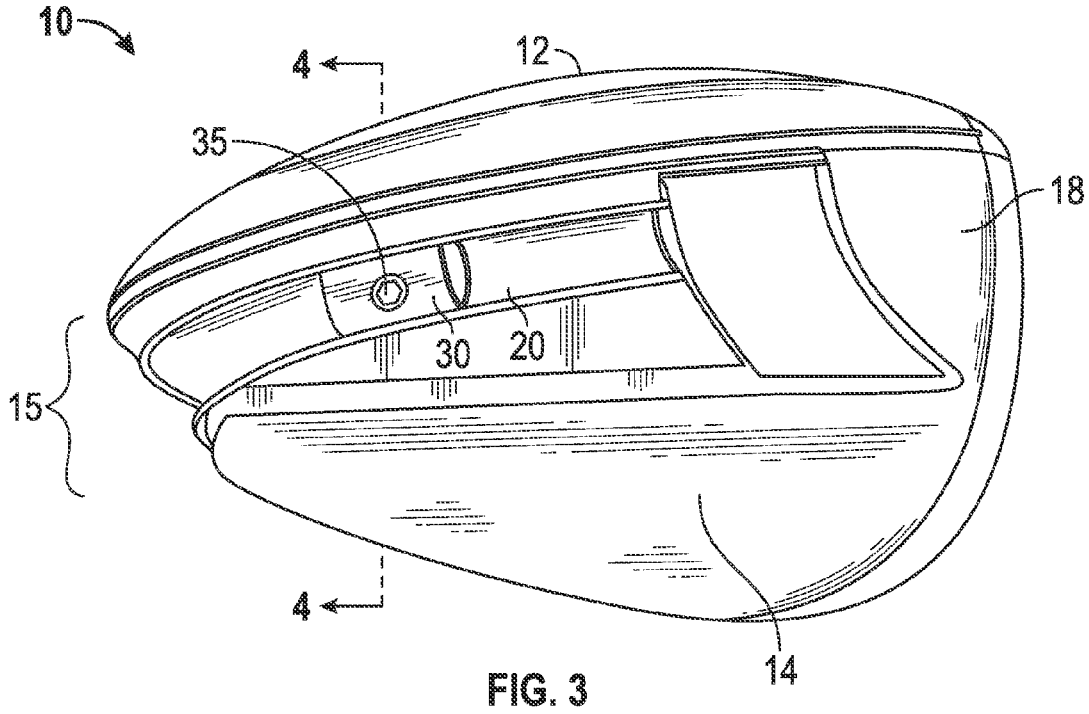
FIG. 3 is a second side perspective view of the embodiment shown in FIG. 1.

The design approaches described herein are based on a construction used in a driver head characterized by a composite crown adhesively bonded to a cast titanium body. This particular construction approach permits the crown configuration to be adapted to the inventive weighting scheme with minimal impact on weight and function. However, the weighting embodiments disclosed herein can be used with other constructions, including all titanium, all composite, and a composite body with metal face cup. It can also work in conjunction with at least one adjustable weight port on the sole of the driver head. Shifting weight along the channel described herein allows for control of center of gravity location.

A first embodiment of the present invention is shown in FIGS. 1-4. The club head 10 comprises a channel 20 disposed within a side or ribbon 15 portion of the club head 10, but may in alternative embodiments may be disposed in the crown 12 and/or sole 14. The channel 20 extends from a heel side 16 of the club head proximate a hosel 11 to a toe side 18 of the club head 10, and has a curved cross-sectional shape with an internal width W1 that is greater than an external opening width W2. The channel 20 may have any of the configurations disclosed in U.S. patent application Ser. No. 13/656,271, the disclosure of which is hereby incorporated by reference in its entirety herein.

Figure 4:
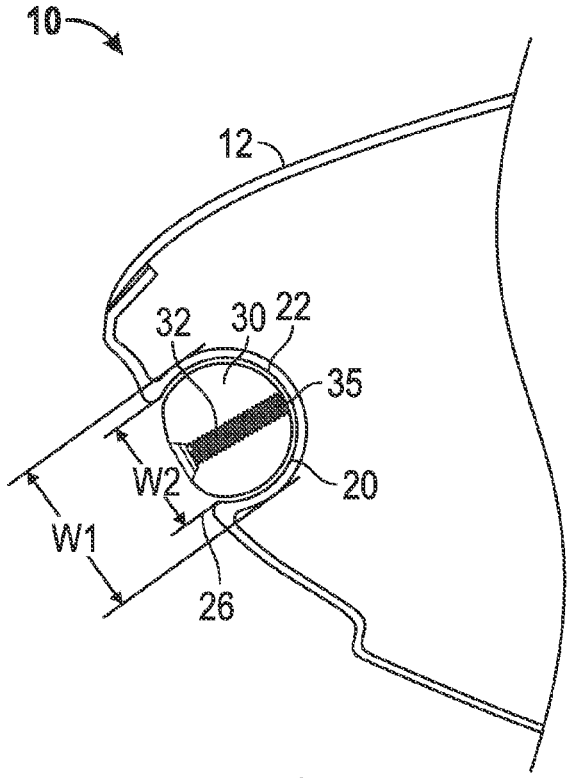
FIG. 4 is a cross-sectional view of the embodiment shown in FIG. 3 along lines 4-4.
Figure 5:
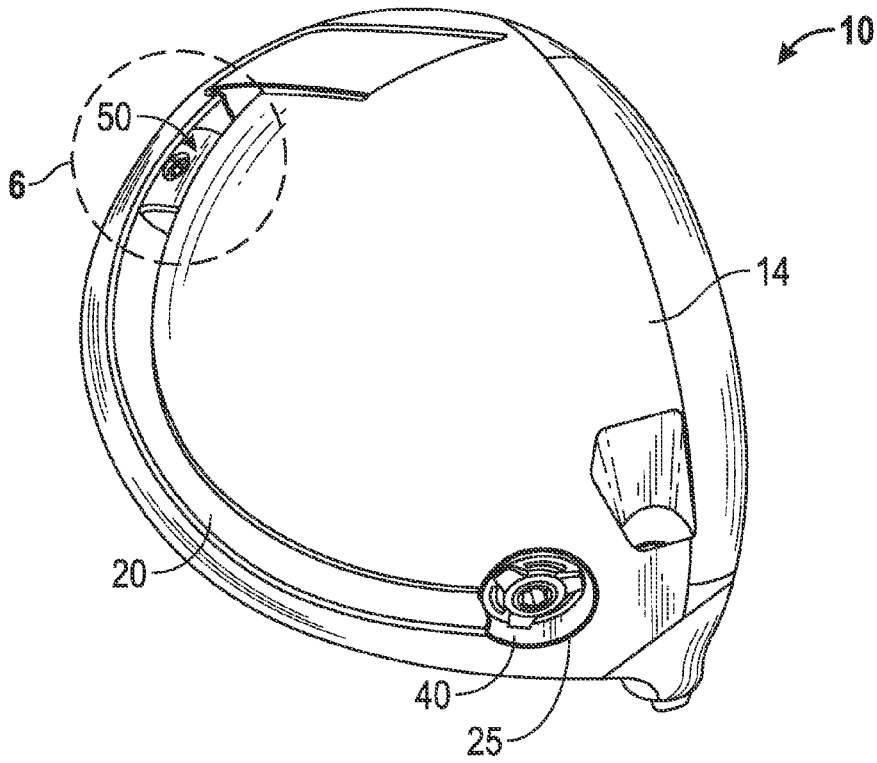
FIG. 5 is a bottom perspective view of a golf club head encompassing a second embodiment of the present invention.

A slidable weight 30 is disposed within the channel 20, and is inserted into the channel 20 at an opening 25 proximate the heel 16, which is closed with a weight screw 40 or a lightweight plug once the slidable weight 30 is inserted into the channel 20. The weight screw 40 or plug and slidable weight 30 can be made of any material known to a person of ordinary skill in the art, and can be selected to better adjust mass properties of the club head. Once the opening 25 is closed, the slidable weight 30 is trapped within the channel 20, though removing the weight screw 40 or the plug allows the slidable weight 30 to be removed and exchanged for one having different structural and/or material characteristics. As shown in FIGS. 1-4, the slidable weight 30 has a greater width than the width W2 of the opening 26 of the channel 20, preventing it from falling out of the channel 20 during use, but has dimensions that allow it to easily slide along the length of the channel 20. In this embodiment, the slidable weight 30 is fixed within the channel at a desired location with a screw 35 that extends through a bore 32 in the slidable weight 30 to engage a floor portion 22 of the channel 20 as shown in FIG. 4 and press the slidable weight 30 against the edges of the opening 26 of the channel 20. In alternative embodiments, the slidable weight 30 is fixed within the channel at a desired location by any means known to a person of ordinary skill in the art, including with a semi-permanent adhesive or one or more of the mechanisms disclosed in U.S. Pat. No. 7,147,573 to DiMarco and U.S. Pat. No. 7,166,041 to Evans, the disclosure of each of which is hereby incorporated by reference in its entirety herein.

Figure 6:
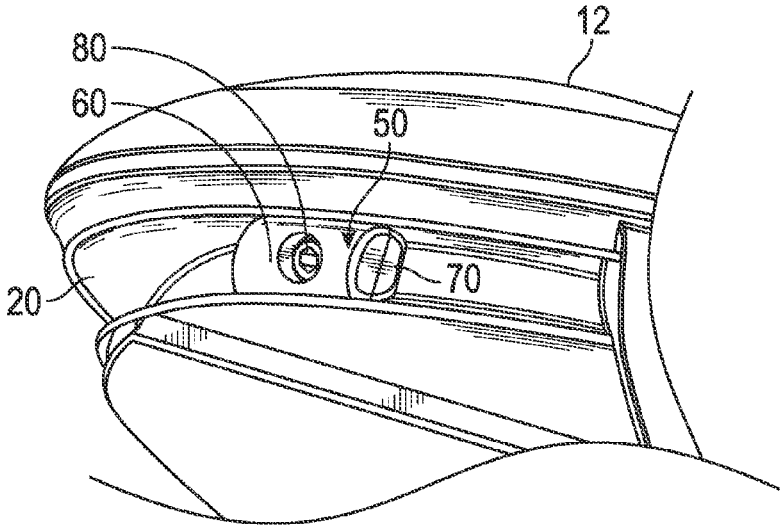
FIG. 6 is an enlarged view of the circled portion in FIG. 5, with the weight in a movable configuration.
Figure 7:
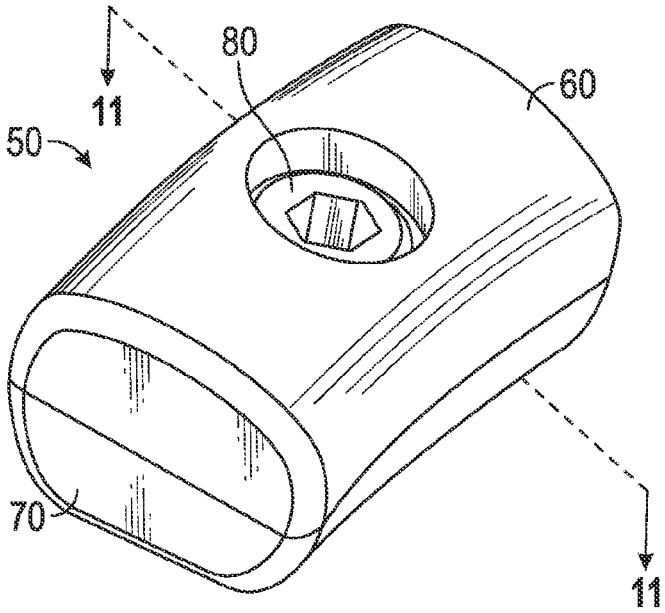
FIG. 7 is a side perspective view of the weight shown in FIG. 6.
Figure 8:
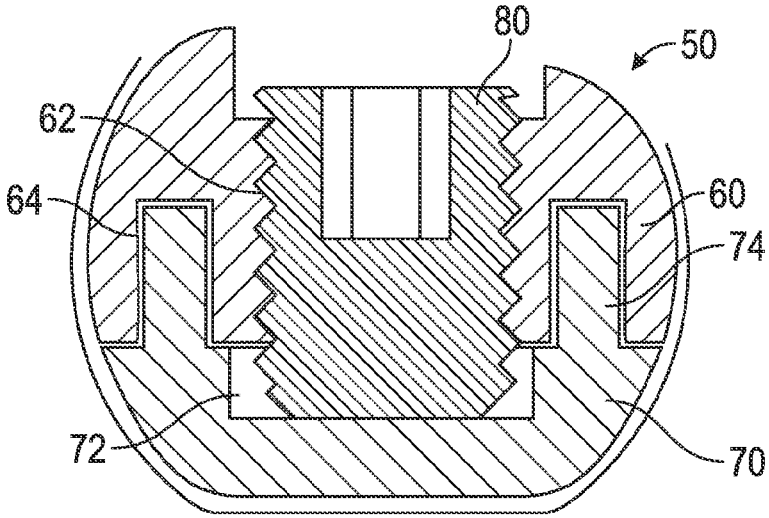
FIG. 8 is a cross-sectional view of the weight shown in FIG. 7 along lines 8-8.

A second, preferred embodiment of the present invention is shown in FIGS. 5-11. In this embodiment, the club head 10 includes the channel 20, opening 25, and weight screw 40 of the first embodiment, but the slidable weight 50 of this embodiment is semi-permanently fixed within the channel 20 via an expandable, multi-piece construction. As shown in FIGS. 6-11, the slidable weight 50 comprises an upper portion 60 having a threaded bore 62 and a depression 64, a lower portion 70 having a cavity 72 and a projection 74, and a bolt 80, though in an alternative embodiment the upper portion 60 may have a projection and the lower portion 70 may have a depression. As shown in FIG. 8, the projection 74 of the lower portion 70 fits within the depression 64 of the upper portion 60 and prevents the slidable weight 50 from falling apart as it is moved within the channel 20 of the present invention.

Figure 9:
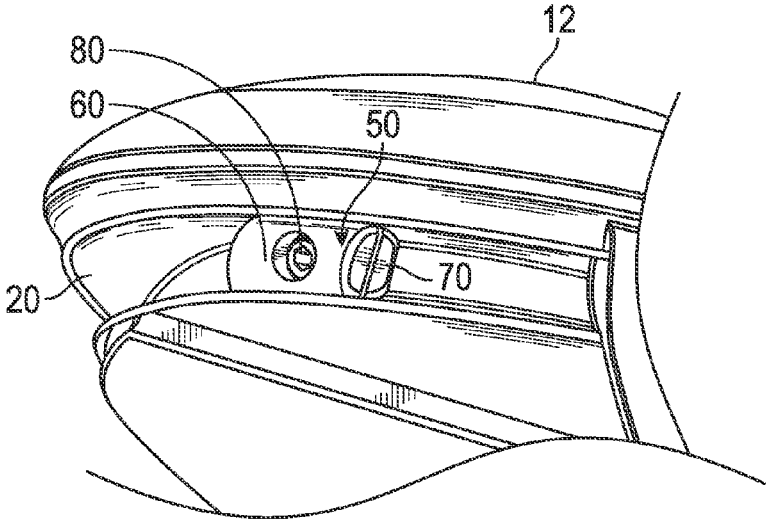
FIG. 9 is an enlarged view of the circled portion in FIG. 5, with the weight in a fixed configuration.
Figure 10:
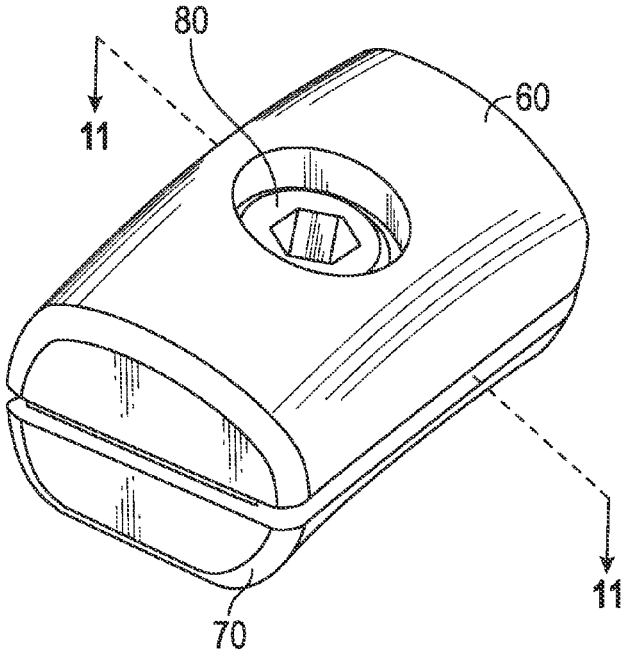
FIG. 10 is a side perspective view of the weight shown in FIG. 9.
Figure 11:
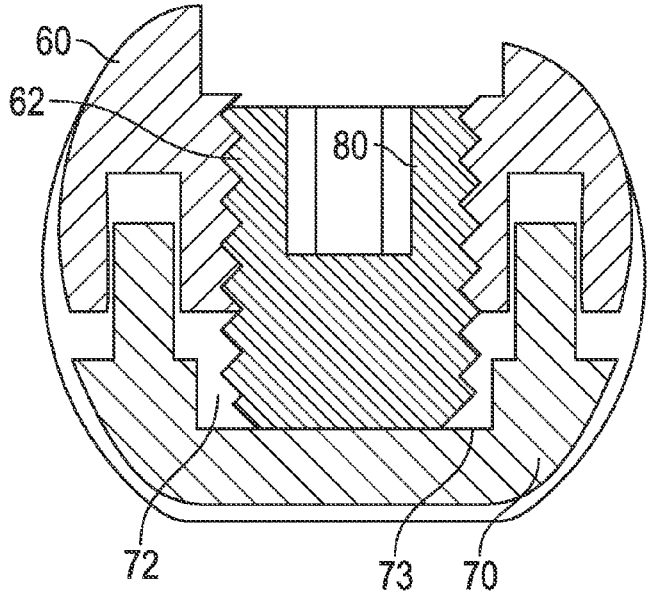
FIG. 11 is a cross-sectional view of the weight shown in FIG. 10 along lines 11-11.

While in the configuration shown in FIGS. 6-8, the dimensions of the slidable weight 50 are such that the slidable weight 50 fits loosely within the channel 20 and can be moved along the length of the channel 20, though the slidable weight 50 still has a width that is great enough to prevent it from falling out of the channel 20. When a golfer has moved the slidable weight 50 to a desired position within the channel 20, he or she can tighten the bolt 80, which causes the bolt 80 to move downward within the threaded bore 62, press against the floor 73 of the cavity 72 of the lower portion 70 of the weight, and push the upper portion 60 of the slidable weight 50 away from the lower portion 70, as shown in FIGS. 9-11. As it is pushed upwards, the upper portion 60 of the slidable weight 50 presses against the sides of the channel 20, effectively using friction to wedge the slidable weight 50 into a fixed position within the channel 20. In the preferred embodiment, at least one, and preferably both, of the upper portion 60 and lower portion 70 of the slidable weight 50 is composed of a metal material, particularly stainless steel, that is co-molded with a polymeric material, and preferably rubber, to increase friction between the slidable weight 50 and the walls of the channel 20 and more securely fix the slidable weight 50 within the channel 20.

Because the opening of the channel 20 has a smaller width W2 than the width of the slidable weight 50, the slidable weight 50 does not fall out of the channel 20 when it is in its expanded configuration. In this way, the slidable weight 50 can be reversibly fixed at any location within the channel 20, not just at points within the channel 20 that have predetermined openings or notches as required in prior art clubs such as those disclosed in U.S. Pat. Nos. 7,611,424 and 8,016,694.

Figure 12:
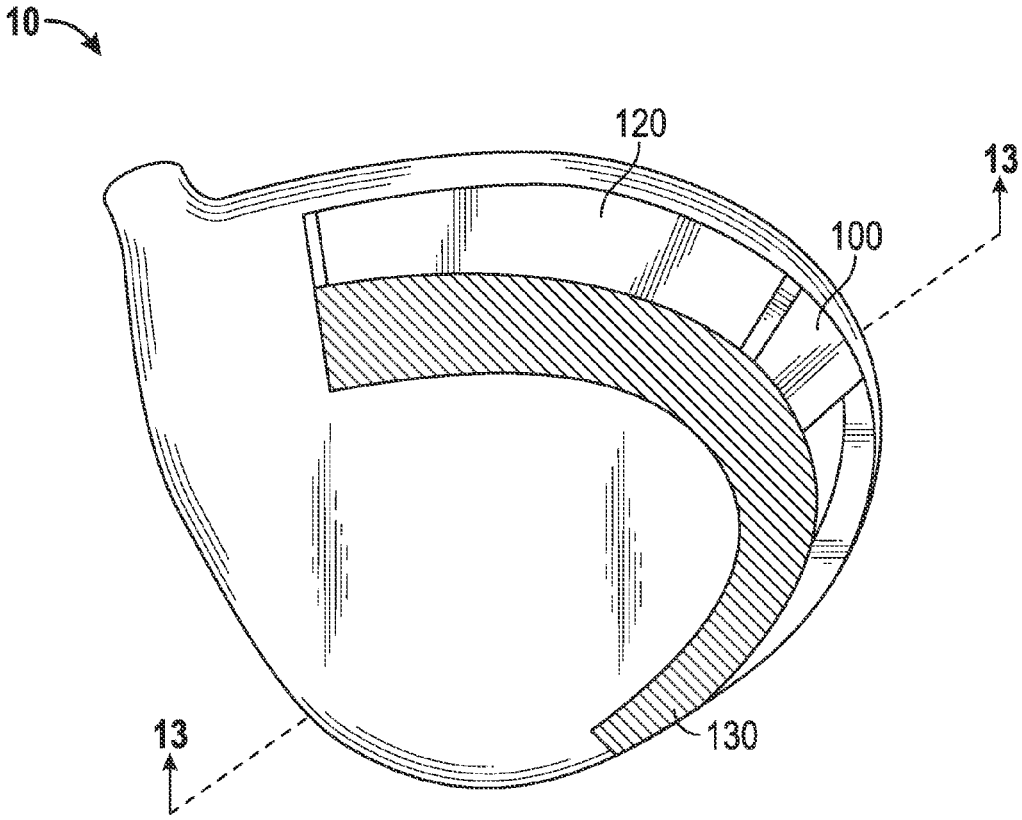
FIG. 12 is a bottom perspective view of a golf club head encompassing a third embodiment of the present invention.
Figure 13:
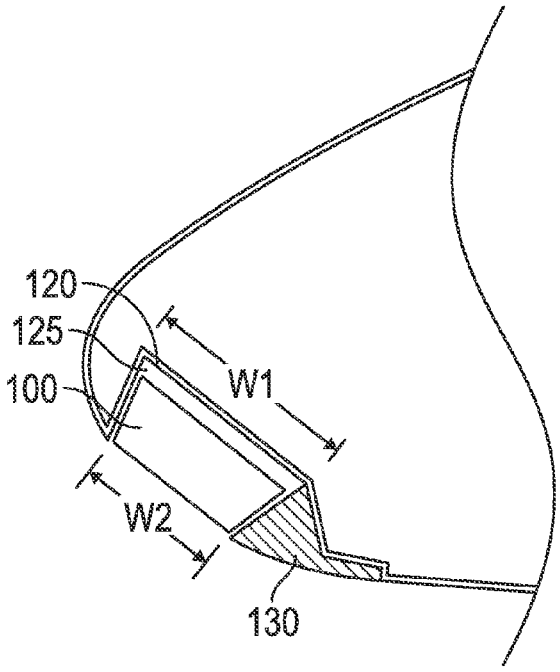
FIG. 13 is a cross-sectional view of the embodiment shown in FIG. 12 along lines 13-13.

A third embodiment of the present invention is shown in FIGS. 12 and 13. In this embodiment, the slidable weight 100 is trapezoidal, and the channel 120 is formed from a recessed part 125 of the sole 14 or ribbon 15 of the club head 10 and a cover fixture 130 that traps the slidable weight 100 within the channel 20. This embodiment may include a weight screw 40 or plug as disclosed in the first and second embodiments, but it is not necessary in order to trap the slidable weight 100 within the channel 120. In order to assemble this embodiment, the slidable weight 100 is placed within the recessed part 125 and the cover fixture 130 is permanently or removably affixed to the sole 14 or ribbon 15. The slidable weight 100 may be fixed at any location within the channel 120 using any of the means disclosed herein. As in the other embodiments disclosed herein, the slidable weight 100 has a width that is larger than the width W2 of the opening of the channel 120, preventing the slidable weight 100 from falling out of the channel 120 during use.

Figure 14:
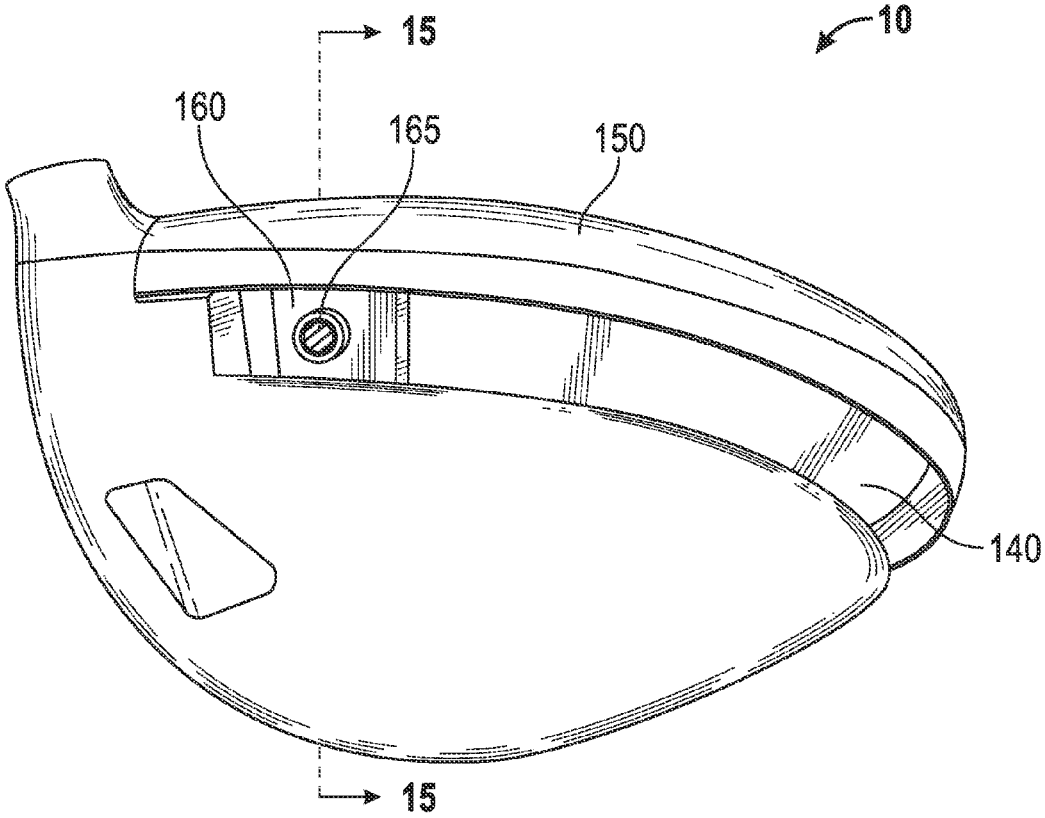
FIG. 14 is a side perspective view of a golf club head encompassing a fourth embodiment of the present invention.
Figure 15:
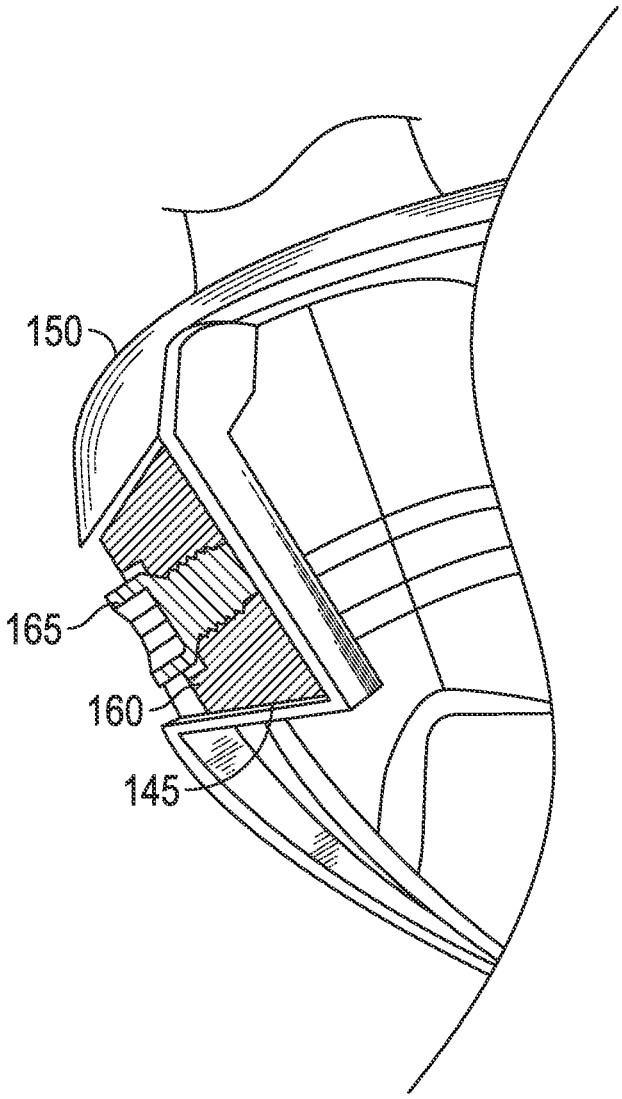
FIG. 15 is a cross-sectional view of the embodiment shown in FIG. 14 along lines 15-15.

A fourth embodiment of the present invention is shown in FIGS. 14 and 15. In this embodiment, the channel 140 is formed from a recessed portion 145 of the sole 14 or ribbon 15 of the club head 10 and a separate crown piece 150, which preferably is formed from a composite material. As in the third embodiment, the slidable weight 160 of this embodiment is trapezoidal and may be fixed within the channel 140 with a bolt 165 or by any other means disclosed herein. As in the third embodiment, this embodiment may be assembled by placing the slidable weight 160 within the recessed portion 145 and then permanently or removably affixing the crown piece 150 to the rest of the club head 10, trapping the slidable weight 160 within the channel 140.

In alternative embodiments, the channel 20 may extend from the sole 14 to the crown 12 or be disposed entirely on the crown 12. In each of the embodiments disclosed herein, the face and sole 14 of the club head 10 preferably are formed from a metal material, while the crown 12 is formed from a non-metal material such as composite. In other embodiments, the club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a body comprising a channel and a port;

an expandable weight comprising an upper portion, a lower portion, and a bolt; and a plug sized to fit within the port, wherein the expandable weight is disposed within and movable to any point within the channel, wherein at least one of the upper portion and the lower portion is co-molded with a rubber material, and wherein tightening the bolt pushes the upper portion and lower portion away from one another in a direction perpendicular to a floor of the channel, presses the upper portion against at least one side of the channel, and reversibly fixes the expandable weight in place within the channel.

2. The golf club head of claim 1, wherein the upper portion comprises a depression and a threaded bore sized to receive the bolt, and wherein the lower portion comprises a cavity and a projection sized to fit within the depression.

3. The golf club head of claim 1, wherein the upper portion comprises a projection and a threaded bore sized to receive the bolt, and wherein the lower portion comprises a cavity and a depression sized to receive the projection.

4. The golf club head of claim 1, wherein the channel comprises an open, first terminal end and a closed, second terminal end, wherein the port is disposed at the first terminal end, and wherein inserting the plug into the weight port closes the first terminal end of the channel.

5. The golf club head of claim 4, wherein the port is a weight port and wherein the plug is a weight screw.

6. The golf club head of claim 1, wherein the channel comprises an innermost surface and an opening, wherein the opening comprises a first width, wherein the innermost surface comprises a second width, wherein the expandable weight comprises a third width, and wherein the first width is less than the second width and less than the third width.

7. The golf club head of claim 1, wherein the body comprises a face, a crown, and a sole.

8. The golf club head of claim 7, wherein the body further comprises a ribbon, and wherein the channel and the weight port are each disposed within the ribbon.

9. The golf club head of claim 1, wherein the channel is tube shaped.

10. The golf club head of claim 1, wherein the golf club head is selected from the group consisting of a driver head, a fairway wood head, and a hybrid head.

11. A driver-type golf club head comprising:

a composite crown;

a titanium body comprising a face, a sole, a channel, and a weight port;

a weight screw sized to fit within the weight port; and an expandable weight comprising an upper portion, a lower portion, a bolt, and a first width, wherein at least one of the upper portion and the lower portion comprises a metal material that is co-molded with a rubber material, wherein the channel comprises an opening having a second width and an innermost surface having a third width, wherein the second width is less than both the first width and the third width, wherein the expandable weight is contained within and movable to any point within the channel, and wherein tightening the bolt pushes the upper portion and lower portion away from one another in a direction perpendicular to a floor of the channel, presses the upper portion against at least one side of the channel, and reversibly fixes the expandable weight in place within the channel.

12. The driver-type golf club head of claim 11, wherein the channel comprises an open, first terminal end and a closed, second terminal end, wherein the weight port is disposed at the first terminal end, and wherein inserting the weight screw into the weight port closes the first terminal end of the channel and prevents the expandable weight from leaving the channel.

* * * * *